US006414537B1

(12) United States Patent
Smith

(10) Patent No.: US 6,414,537 B1
(45) Date of Patent: Jul. 2, 2002

(54) VOLTAGE REFERENCE CIRCUIT WITH FAST DISABLE

(75) Inventor: Gregory J. Smith, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/660,254

(22) Filed: Sep. 12, 2000

(51) Int. Cl.[7] ..... G05F 1/10
(52) U.S. Cl. ..... 327/540; 327/538; 327/541
(58) Field of Search ..... 327/538, 540, 327/541, 543, 544

(56) References Cited

U.S. PATENT DOCUMENTS

| | | | | | |
|---|---|---|---|---|---|
| 4,908,566 | A | * | 3/1990 | Tesch | 323/280 |
| 5,504,452 | A | * | 4/1996 | Takenaka | 327/540 |
| 5,631,598 | A | * | 5/1997 | Miranda et al. | 327/540 |
| 5,828,245 | A | * | 10/1998 | Brambilla et al. | 327/540 |
| 5,892,381 | A | * | 4/1999 | Koifman et al. | 327/541 |
| 5,929,617 | A | | 7/1999 | Brokaw | 323/380 |

OTHER PUBLICATIONS

LM4140, High Precision Low Noise Low Dropout Voltage Reference, National Semiconductor Datasheet, Jun. 2000.
LP2975, MOSFET LDO Driver/Controller, National Semiconductor Datasheet, Jul. 2000.

* cited by examiner

*Primary Examiner*—Timothy P. Callahan
*Assistant Examiner*—An T. Luu
(74) *Attorney, Agent, or Firm*—Beyer Weaver & Thomas, LLP

(57) ABSTRACT

A reference-producing integrated circuit that is able to rapidly transition from an enable mode to a disable mode is disclosed. The reference-producing integrated circuit can, for example, be a voltage reference integrated circuit or a voltage regulator. In one implementation, the voltage reference integrated circuit or the voltage regulator can provide a low dropout voltage output. The reference-producing integrated circuit is particularly useful for reducing power consumption by electrical circuitry (e.g., portable computing devices) being power managed at least in part through control of the voltage reference supplied to the electrical circuitry.

27 Claims, 3 Drawing Sheets

VOLTAGE REFERENCE CIRCUIT WITH FAST DISABLE

BACKGROUND OF THE INVENTION

1. Field of the Invention

The present invention relates to integrated circuits and, more particularly, to voltage reference circuits.

2. Description of the Related Art

Precision voltage references are critical elements of various circuits, such as portable devices, instrumentation and test equipment, data acquisition systems, medical equipment, servo systems, and the like. Voltage reference circuits are used to supply a steady and reliable voltage reference to other circuitry or systems. Similarly, low dropout voltage (LDO) regulators are also used to provide regulated voltages in a precise and reliable manner. Recently, voltage references or regulators have begun to utilize complimentary metal-oxide-semiconductor (CMOS) technology.

FIG. 1 is a schematic diagram of a conventional voltage reference circuit 100 according to one embodiment of the invention. The conventional voltage reference circuit 100 includes a differential amplifier 102 that receives an input reference voltage ($V_{REF}$) at one input terminal and receives a feedback voltage at another input terminal. An output terminal of the differential amplifier 102 is coupled to an output transistor 104. The output transistor 104 is typically a LDO power device. The conventional voltage reference circuit 100 also includes a resistor-capacitor network 106. The resistor-capacitor network 106 includes a load capacitor ($C_L$) and resistors $R_1$ and $R_2$. The resistor-capacitor network 106 is provided between an output node 108 and ground potential. The feedback voltage is supplied to the differential amplifier 102 from a node 110 within the resistor-capacitor network 106. The load capacitor ($C_L$) is required to be rather large (e.g., at least 1 $\mu$F) so that loop stabilization results. The conventional voltage reference circuit 100 also receives an enable signal that is supplied to the differential amplifier 102. When the enable signal operates to "enable" the conventional voltage reference circuit 100, the output of the differential amplifier 102 activates the output transistor 104 to pull the output node 108 towards the power supply voltage ($V_{DD}$) and thus produce a precise output reference voltage ($V_{OUT}$). On the other hand, when the enable signal operates to "disable" the differential amplifier 102, the output of the differential amplifier 102 deactivates the output transistor 104. In the disable situation, ideally the output voltage ($V_{OUT}$) would immediately drop to ground potential. However, with respect to the conventional voltage reference circuit 100, the resistor-capacitor network is coupled to the output terminal 108 and thus, before the output voltage ($V_{OUT}$) can be dropped to a near ground potential, the charge stored at the load capacitor ($C_L$) needs to discharge through the resistors $R_1$ and $R_2$ to ground. This induces a RC time constant delay that slows the decay of the output voltage ($V_{OUT}$) to near ground potential. Because of the rather large capacitance of the load capacitor ($C_L$) and the non-trivial resistances of the resistors $R_1$ and $R_2$ (e.g., typically at least 10 k ohms), the RC time constant delay imposed causes the output voltage ($V_{OUT}$) to slowly respond to the disable situation. Accordingly, while large load capacitors are used by conventional voltage reference circuits for loop stabilization, the large load capacitors hinder the rapid disabling of conventional voltage reference circuits. In some applications for voltage references or regulators, the failure to provide rapid disabling leads to undesirable effects. For example, in one common application, a voltage reference circuit is utilized to provide a precise voltage reference to an electrical system, such as a portable computing device. In such an application, when the voltage reference circuit is disabled, it is intended that the power to the electrical system be removed. However, the slow responsiveness of the output voltage ($V_{OUT}$), when disabling the voltage reference circuit, causes the electrical system to undesirably consume power during the time it takes for the voltage reference circuit to become fully disabled (i.e., $V_{OUT}$~=0). Accordingly, this leads to poor power management for the electrical system because until the voltage reference becomes fully disabled, the circuitry within the electrical system will continue to draw power rom a power source (e.g., a battery) of the portable computing device.

Thus, there is a need for reference-producing circuits that not only remain stable but also rapidly transition between enable and disable modes.

SUMMARY OF THE INVENTION

Broadly speaking, the invention relates to a reference-producing integrated circuit that is able to rapidly transition from an enable mode to a disable mode. The reference-producing integrated circuit can, for example, be a voltage reference integrated circuit or a voltage regulator. In one implementation, the voltage reference integrated circuit or the voltage regulator can provide a low dropout voltage output. The reference-producing integrated circuit is particularly useful for reducing power consumption by electrical circuitry (e.g., portable computing devices) being power managed at least in part through control of the voltage reference supplied to the electrical circuitry.

The invention can be implemented in numerous ways including as a method, a system, and a device. Several embodiments of the invention are discussed below.

As an integrated circuit, one embodiment of the invention includes at least: an amplifier, an output transistor, a load capacitor, a resistive element, and a discharge transistor. The amplifier produces an output signal based on a feedback voltage and a reference voltage. The output transistor having a gate terminal, a drain terminal and a source terminal, the gate terminal being operatively connected to receive the output signal, the drain terminal being operatively connected to an output terminal, and the source terminal being operatively connected to a first source voltage level. The load capacitor is operatively connected between the output terminal and a second source voltage level. The resistive element is operatively connected between the output terminal and the second source voltage level. The resistive element includes at least a series connection of first and second resistors, with the first resistor being operatively connected between the output terminal and a feedback node, and with the second resistor being operatively connected between the feedback node and the second source voltage level. The discharge transistor having a gate terminal, a drain terminal and a source terminal, the gate terminal being operatively connected to an enable signal supplied to the integrated circuit, the drain terminal being operatively connected to the output terminal, and the source terminal being operatively connected to the second source voltage level. The feedback voltage is provided to the amplifier by being operatively connected to the feedback node.

As a reference voltage integrated circuit for receiving a voltage reference input, an enable signal and a voltage reference output, one embodiment of the invention includes at least: a differential amplifier, the differential amplifier producing an output signal based on a voltage difference between a feedback voltage and the reference voltage input; an output transistor having a gate terminal, a drain terminal and a source terminal, the gate terminal being operatively connected to receive the output signal, the drain terminal being operatively connected to an output terminal, and the source terminal being operatively connected to a first source voltage level; a load capacitor operatively connected between the output terminal and a second source voltage level; a resistive element operatively connected between the output terminal and the second source voltage level, the resistive element including at least a series connection of first and second resistors, with the first resistor being operatively connected between the output terminal and a feedback node, and with the second resistor being operatively connected between the feedback node and the second source voltage level; and a discharge transistor having a gate terminal, a drain terminal and a source terminal, the gate terminal being operatively connected to the enable signal, the drain terminal being operatively connected to the output terminal, and the source terminal being operatively connected to the second source voltage level.

As a method for operating a voltage reference circuit to reduce power consumption in an electrical system, one embodiment of the invention includes the acts of: providing a voltage reference output from the voltage reference circuit to the electrical system, the power consumed by the electrical system being dependent on the voltage reference level; receiving a disable request to disable the voltage reference circuit; and thereafter, in response to the disable request, rapidly pulling the voltage reference output to about ground potential.

The advantages of the invention are numerous. Different embodiments or implementations may yield one or more of the following advantages. One advantage of the invention is that being able to provide a rapid disable of a voltage reference facilitates improved power management in associated circuitry. The improved power management can conserve a battery's charge in cases of a battery powered, portable device. Another advantage of the invention is that overhead circuitry for providing rapid disable is minimal.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention pertains to a reference-producing integrated circuit that is able to rapidly transition from an enable mode to a disable mode. The reference-producing integrated circuit can, for example, be a voltage reference integrated circuit or a voltage regulator. In one implementation, the voltage reference integrated circuit or the voltage regulator can provide a low dropout voltage output. The reference-producing integrated circuit is particularly useful for reducing power consumption by electrical circuitry (e.g., portable computing devices) being power managed at least in part through control of the voltage reference supplied to the electrical circuitry.

When voltage references are used in portable equipment (e.g., portable computing devices), one desirable feature of the voltage reference circuits is their ability to rapidly disable and enable the voltage reference circuit. By doing so, power management for the portable equipment is able to be efficiently achieved. More particularly, when the reference voltage is not needed by the portable equipment, the reference voltage circuit is disabled so that the power consumed by the portable equipment can be drastically reduced. Hence, it is desirable that the voltage reference output of a voltage reference circuit not only powers-up (enables) rapidly but also powers-down (disables) rapidly. Unfortunately, however, conventional voltage references or LDO regulators provide predominantly only one-directional current drive, namely, high "turn-on" current for rapid power-up. Unfortunately, the conventional designs do not provide power-down (or disable) in a rapid manner. The invention provides a voltage reference circuit that not only powers-up (enables) rapidly but also powers-down (disables) rapidly.

Embodiments of this aspect of the invention are discussed below with reference to FIGS. 2–3. However, those skilled in the art will readily appreciate that the detailed description given herein with respect to these figures is for explanatory purposes as the invention extends beyond these limited embodiments.

Figure 1:
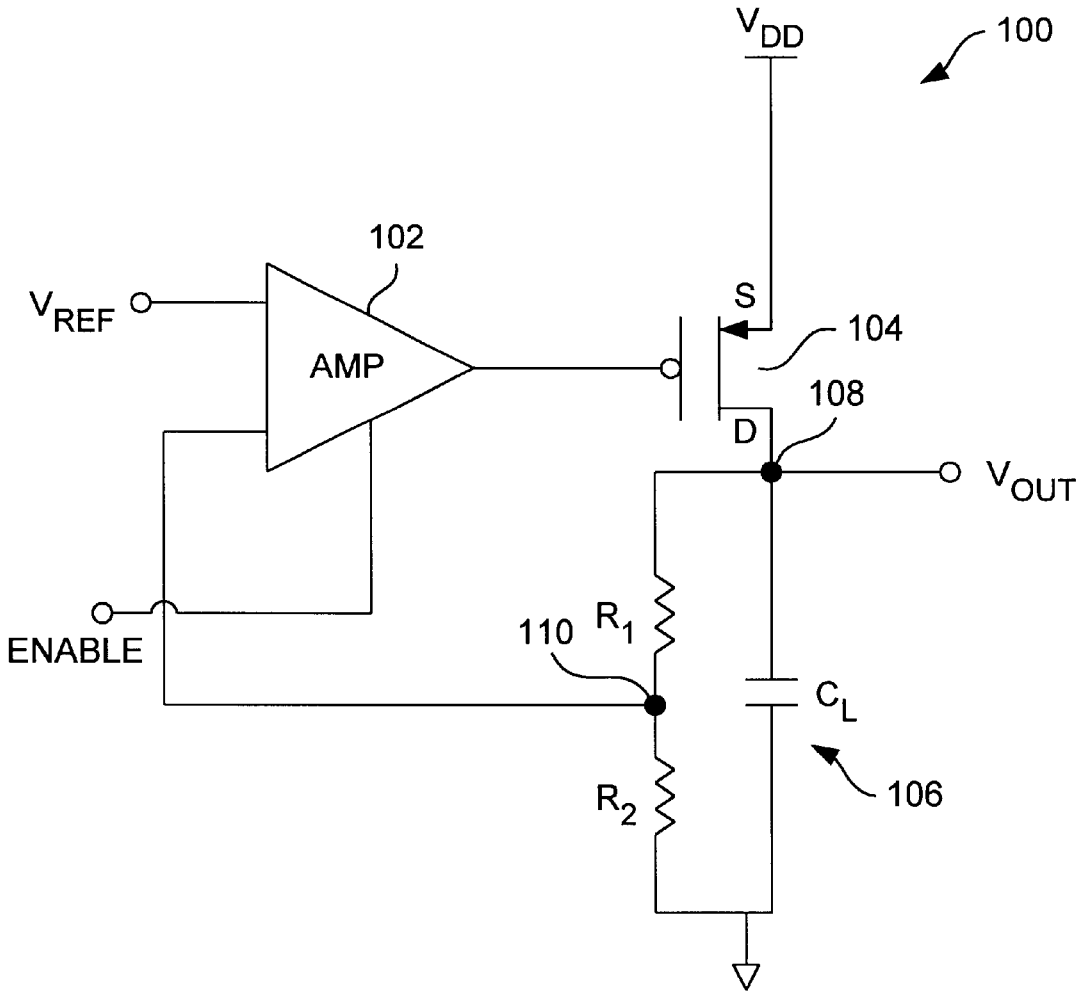
FIG. 1 (Prior Art)
FIG. 1 is a schematic diagram of a conventional voltage reference circuit according to one embodiment of the invention.
Figure 2:
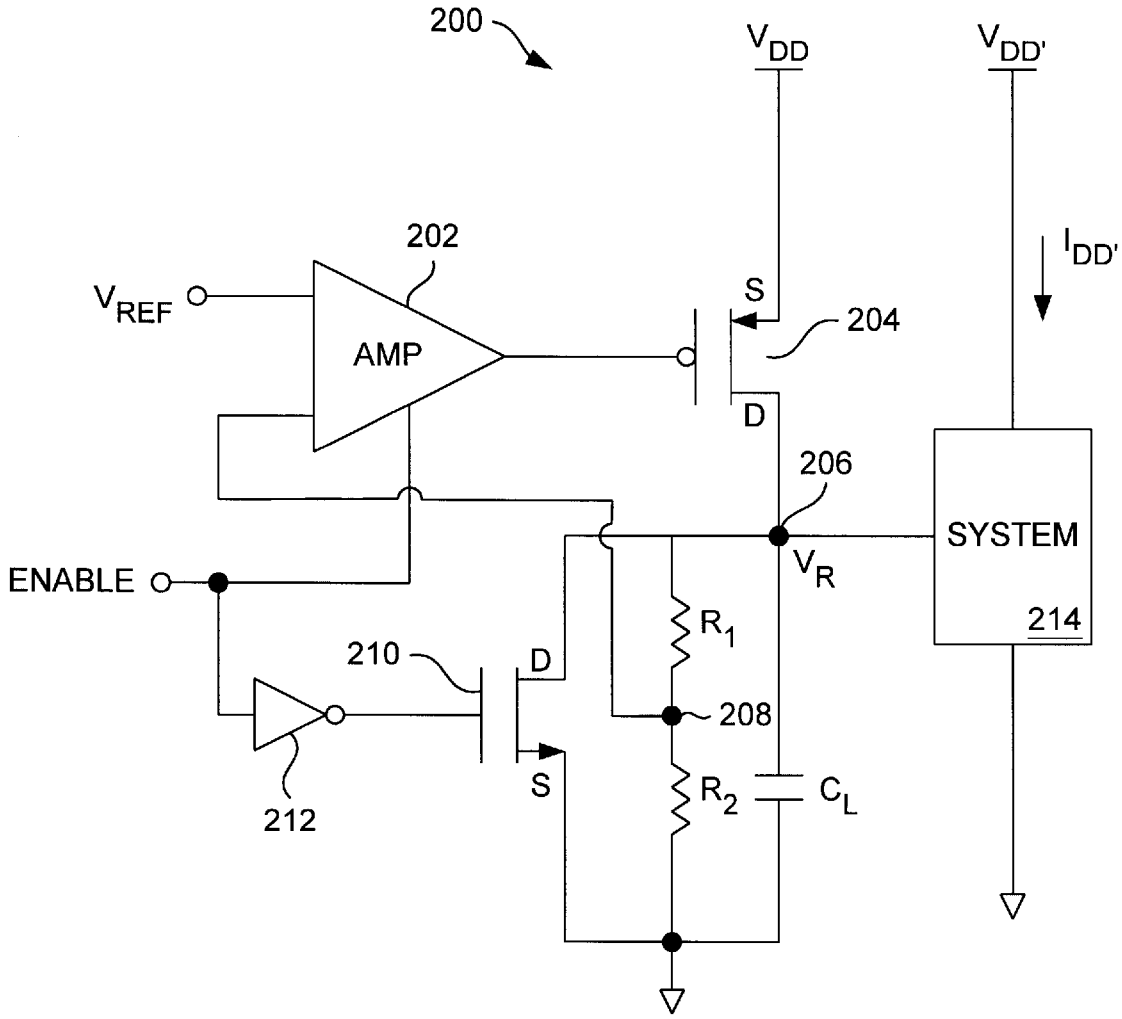
FIG. 2 is a schematic diagram of a voltage reference circuit according to one embodiment of the invention.

FIG. 2 is a schematic diagram of a voltage reference circuit 200 according to one embodiment of the invention. The voltage reference circuit 200 receives an input reference voltage ($V_{REF}$) and an enable signal, and produces an output voltage reference ($V_R$). The voltage reference circuit 200 includes an amplifier 202 that receives the input reference voltage ($V_{REF}$) at a first input terminal and receives a feedback voltage at a second input terminal. In one embodiment, the amplifier 202 is a differential amplifier. The amplifier 202 also has an output terminal that supplies an output signal to a gate terminal of an output transistor 204. The output transistor 204 also has a source terminal connected to a power source potential ($V_{DD}$). A drain terminal of the output transistor 204 is coupled to an output terminal 206. A load capacitor ($C_L$) is coupled between the output terminal 206 and a ground potential. In addition, resistor $R_1$ and resistor $R_2$ are connected in series between the output terminal 206 and the ground potential. A feedback node 208 is provided at the connection of the resistor $R_1$ and resistor $R_2$. The feedback terminal 208 supplies the feedback voltage to the second input terminal of the amplifier 202. The connections between the amplifier 202, the output transistor 204, the load capacitor ($C_L$), and the resistors $R_1$ and $R_2$ form a control loop. The control loop cause the voltage reference circuit 200 to produce the output voltage reference ($V_R$) that precisely follows the input reference voltage ($V_{REF}$) when the voltage reference circuit 200 is enabled. The load capacitor ($C_L$) is provided to provide loop stability as well as filtering transient responses. Typically, the load capacitor ($C_L$) is rather large (e.g., at least 1 $\mu$F) and often in the range of 1–1000 $\mu$F. The resistors $R_1$ and $R_2$ are typically at least 1 k ohms and often in the range of 1–100 k ohms. Still further, the voltage reference circuit 200 includes a discharge transistor 210. The discharge transistor 210 includes a gate terminal that receives the enable signal after being inverted by an inverter 212. A drain terminal for the discharge transistor 210 is coupled to the output terminal 206, and the source terminal of the discharge transistor 210 is coupled to the ground potential.

In a typical application, the output voltage reference ($V_R$) is supplied to an electrical system 214. The electrical system 214 is not part of the voltage reference circuit 200, but its utilization is controlled by the output voltage reference ($V_R$) provided by the voltage reference circuit 200. The electrical system 214, in this application, is not supplied with power from the voltage reference circuit 200 but is instead supplied with power from a power source ($V_{DD}'$). The power source ($V_{DD}'$) supplies a current ($I_{DD}$) to the electrical system 214, the current ($I_{DD}$) being a function of the output voltage reference ($V_R$) provided by the voltage reference circuit 200. The power source ($V_{DD}'$) may be the same as, or different from, the power source potential ($V_{DD}$).

The operation of the voltage reference circuit 200 is as follows. The voltage reference circuit 200 receives the input reference voltage ($V_{REF}$) as well as the enable signal. When the enable signal is "high" to indicate that the voltage reference circuit 200 is enabled (enable mode), then the amplifier 202 is active to produce the output signal that is supplied to the gate terminal of the output transistor 204. In this case, the output signal is of a low voltage nature so as to turn-on the output transistor 204, and thus pulls the output reference voltage ($V_R$) at the output terminal 206 towards the power supply potential ($V_{DD}$). As the output terminal is pulled towards the power supply potential ($V_{DD}$), the load capacitor ($C_L$) is charged. While enabled, the control loop is operational and causes the output voltage reference ($V_R$) to be produced in a precise manner even when changes in load current at the output terminal 206 occur. It should also be noted that while the enable signal is "high", the discharge transistor 210 de-activates as its gate terminal receives a "low" signal from the inverter 212.

Subsequently, when the voltage reference circuit 200 is to be disabled (disable mode), the enable signal is brought "low". The "low" enable signal disables the amplifier 202 which, when disabled, renders the output signal of the amplifier 202 "high". The "high" output signal causes the output transistor 204 to turn-off. Once the output transistor 204 has turned-off, the output terminal 206 is effectively no longer coupled to the positive power supply potential ($V_{DD}$). In addition, the "low" enable signal, after passing through the inverter 212, causes the discharge transistor 210 to turn-on. Once the discharge transistor 210 has turned-on, the output terminal 206 is coupled (or clamped) to ground through the discharge transistor 210. Hence, during the disable mode, the discharge transistor 210 provides a low resistance path for the discharge of the charge of the load capacitor ($C_L$). As a result, the output reference voltage ($V_R$) at the output terminal 206 is rapidly decreased to the ground potential. In effect, the RC time constant is substantially reduced by reducing the resistance to a very small amount.

As noted above, by providing rapid decay of the output reference voltage ($V_R$) upon the voltage reference circuit 200 being disabled, the system 214 is controlled such that it consumes less power. More particularly, because the amount of power the system 214 draws from the power supply ($V_{DD}$) is dependant upon the voltage level of the output reference voltage ($V_R$), once it is decided to turn-off (or reduce) the power to the system 214, the voltage reference circuit 200 is able to rapidly drop the output reference voltage ($V_R$) which in turn rapidly stops (or reduces) the power the system 214 draws from the power source ($V_{DD}'$). The improved disabling of the voltage reference circuit 200 offered by the invention can thus reduce power consumption of the system 214 which is particularly advantageous when the power source ($V_{DD}'$) is a battery.

Figure 3:
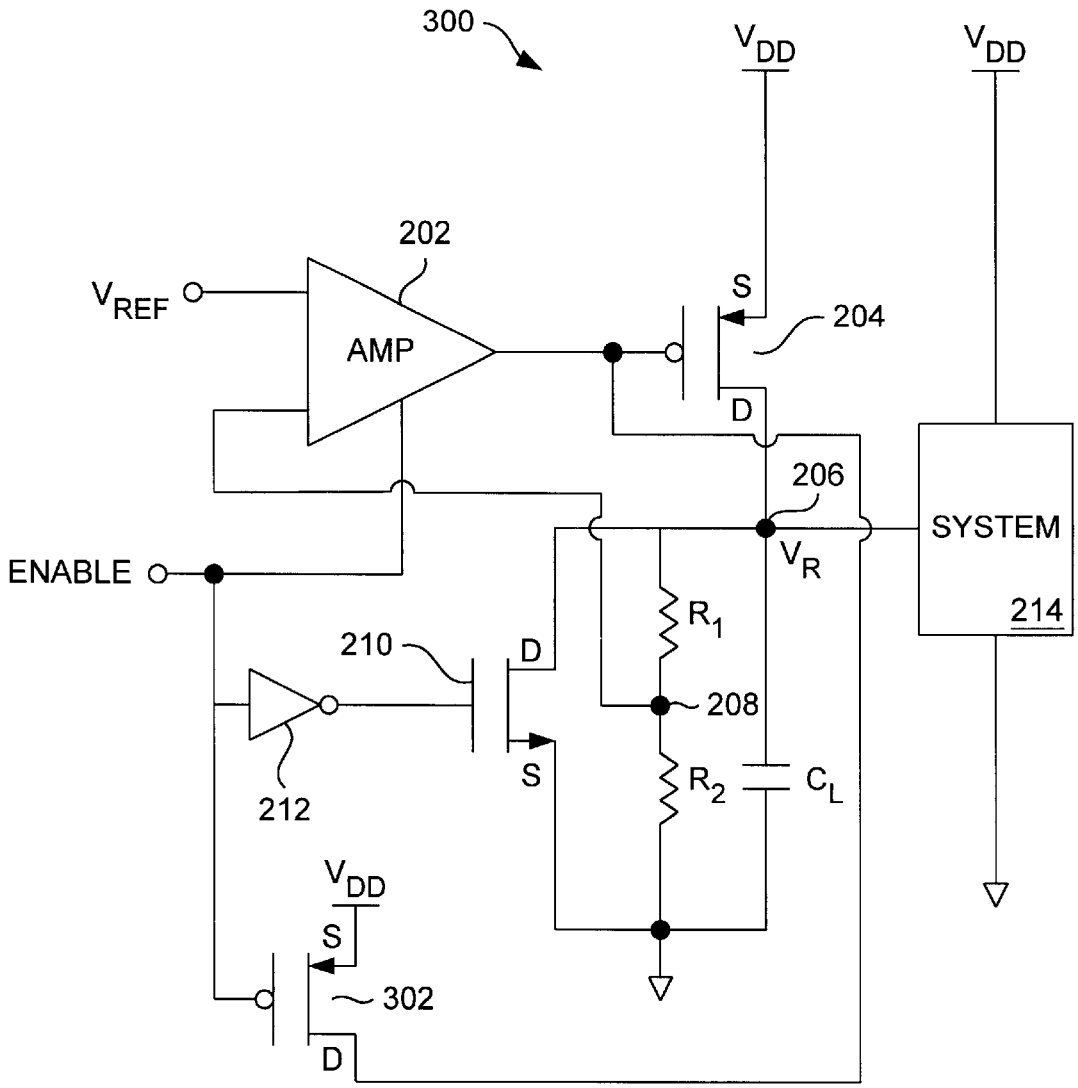
FIG. 3 is a schematic diagram of a voltage reference circuit according to another embodiment of the invention.

FIG. 3 is a schematic diagram of a voltage reference circuit 300 according to another embodiment of the invention. The voltage reference circuit 300 is generally similar to the voltage reference circuit 200 illustrated in FIG. 2. However, the voltage reference circuit 300 further includes a transition transistor 302. The transition transistor 302 has a gate terminal connected to the enable signal, a source terminal connected to the power source potential ($V_{DD}$), and a drain terminal connected to the gate terminal of the output transistor 204. When the enable signal transitions "low" to disable the voltage reference circuit 300, the transition transistor 302 operates to assist in the pulling-up of the gate terminal of the output transistor 204. Although the amplifier 202 also operates to produce a "high" output signal, its responsiveness is not immediate. Hence, by using the transition transistor 302 to rapidly pull-up the gate terminal of the output transistor 204, the output transistor 204 more quickly deactivates, thereby effectively disconnecting the output terminal 206 from the power source potential ($V_{DD}$) with greater speed than would otherwise occur without the transition transistor 302. In effect, the presence of the transition transistor 302 assists with the "turn-off" of the voltage reference circuit 300 so that the output reference voltage ($V_R$) at output node 206 can rapidly be brought to nearly ground potential. In one embodiment, the output transistor 204 is a PMOS device and the discharge transistor 210 is a NMOS device. The drive strength of the output transistor 204 is substantially greater than that of the discharge transistor 210. For example, the W/L of the output transistor might be about 4000 while the width/length (W/L) of the channel of the discharge transistor 210 might be about 200. In another embodiment, the transition transistor 302 is a PMOS device.

The advantages of the invention are numerous. Different embodiments or implementations may yield one or more of the following advantages. One advantage of the invention is that being able to provide a rapid disable of a voltage reference facilitates improved power management in associated circuitry. The improved power management can conserve a battery's charge in cases of a battery powered, portable device. Another advantage of the invention is that overhead circuitry for providing rapid disable is minimal.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. An integrated circuit, comprising:

an amplifier, said amplifier produces an output signal based on a feedback voltage and a reference voltage;

an output transistor having a gate terminal, a drain terminal and a source terminal, the gate terminal being operatively connected to receive the output signal, the drain terminal being operatively connected to an output terminal, and the source terminal being operatively connected to a first source voltage level;

a load capacitor operatively connected between the output terminal and a second source voltage level;

a resistive element operatively connected between the output terminal and the second source voltage level, said resistive element including at least a series connection of first and second resistors, with the first resistor being operatively connected between the output terminal and a feedback node, and with the second resistor being operatively connected between the feedback node and the second source voltage level; and a discharge transistor having a gate terminal, a drain terminal and a source terminal, the gate terminal being operatively connected to an enable signal supplied to said integrated circuit, the drain terminal being operatively connected to the output terminal, and the source terminal being operatively connected to the second source voltage level, wherein the feedback voltage is provided to said amplifier by being operatively connected to the feedback node.

2. An integrated circuit as recited in claim 1, wherein said output transistor has a drive capacity greater than a drive capacity of said discharge transistor.

3. An integrated circuit as recited in claim 2, wherein said output transistor is a PMOS device, and wherein said discharge transistor is a NMOS transistor.

4. An integrated circuit as recited in claim 1, wherein when said amplifier is disabled by the enable signal, then the output terminal is coupled to the second source voltage level by said discharge transistor so that energy stored in said load capacitor can be rapidly discharged so as to rapidly bring the output terminal to approximately the second source voltage level.

5. An integrated circuit as recited in claim 4, wherein said output transistor has a drive capacity greater than a drive capacity of said discharge transistor.

6. An integrated circuit as recited in claim 1, wherein said discharge transistor provide active pull-down of the output terminal when said integrated circuit is disabled by the enable signal.

7. An integrated circuit as recited in claim 1, wherein said integrated circuit is a low voltage dropout output (LDO) device.

8. An integrated circuit as recited in claim 1, wherein the first source voltage level is a positive supply voltage provided by a power source, and wherein the second source voltage level is ground.

9. An integrated circuit as recited in claim 1, wherein said integrated circuit further comprises:

an inverter, said inverter operatively connected between the enable signal and the gate terminal of said discharge transistor.

10. An integrated circuit as recited in claim 1, wherein said integrated circuit is a voltage reference circuit that provides a voltage reference on the output terminal.

11. An integrated circuit as recited in claim 10, wherein the voltage reference is used by a electrical system to reference voltages supplied within said electrical system.

12. An integrated circuit as recited in claim 1, wherein said amplifier is an operational amplifier.

13. An integrated circuit as recited in claim 1, wherein said integrated circuit comprises:

a transition transistor having a gate terminal, a drain terminal and a source terminal, the gate terminal being operatively connected to the enable signal, the drain terminal being operatively connected to the gate terminal of said output transistor, and the source terminal being operatively connected to the first source voltage level.

14. A reference voltage integrated circuit as recited in claim 13, wherein said transition transistor assists with the turn-off of said output transistor when said reference voltage integrated circuit is being disabled by the enable signal.

15. A reference voltage integrated circuit for receiving a voltage reference input, an enable signal and a voltage reference output, comprising:

a differential amplifier, said differential amplifier producing an output signal based on a voltage difference between a feedback voltage and the reference voltage input;

an output transistor having a gate terminal, a drain terminal and a source terminal, the gate terminal being operatively connected to receive the output signal, the drain terminal being operatively connected to an output terminal, and the source terminal being operatively connected to a first source voltage level;

a load capacitor operatively connected between the output terminal and a second source voltage level;

a resistive element operatively connected between the output terminal and the second source voltage level, said resistive element including at least a series connection of first and second resistors, with the first resistor being operatively connected between the output terminal and a feedback node, and with the second resistor being operatively connected between the feedback node and the second source voltage level; and a discharge transistor having a gate terminal, a drain terminal and a source terminal, the gate terminal being operatively connected to the enable signal, the drain terminal being operatively connected to the output terminal, and the source terminal being operatively connected to the second source voltage level.

16. A reference voltage integrated circuit as recited in claim 15, wherein the feedback voltage is provided to said amplifier by being operatively connected to the feedback node.

17. A reference voltage integrated circuit as recited in claim 15, wherein said output transistor is a PMOS device, and wherein said discharge transistor is a NMOS transistor.

18. A reference voltage integrated circuit as recited in claim 15, wherein when said reference voltage integrated circuit is being disabled by the enable signal, then said discharge transistor operates to coupled the output terminal to the second source voltage level.

19. A reference voltage integrated circuit as recited in claim 18, wherein when said reference voltage integrated circuit is disabled by the enable signal, energy stored in said load capacitor can be rapidly discharged.

20. A reference voltage integrated circuit as recited in claim 19, wherein said output transistor is a PMOS device, and wherein said discharge transistor is a NMOS transistor.

21. A reference voltage integrated circuit as recited in claim 19, wherein said output transistor has a drive capacity greater than a drive capacity of said discharge transistor.

22. A reference voltage integrated circuit as recited in claim 15, wherein said reference voltage integrated circuit comprises:

a transition transistor having a gate terminal, a drain terminal and a source terminal, the gate terminal being operatively connected to the enable signal, the drain terminal being operatively connected to the gate terminal of said output transistor, and the source terminal being operatively connected to the first source voltage level.

23. A reference voltage integrated circuit as recited in claim 22, wherein said reference voltage integrated circuit further comprises:

an inverter, said inverter operatively connected between the enable signal and the gate terminal of said discharge transistor.

24. A reference voltage integrated circuit as recited in claim 22, wherein said transition transistor assists with the turn-off of said output transistor when said reference voltage integrated circuit is being disabled by the enable signal.

25. A reference voltage integrated circuit as recited in claim 24, wherein said output transistor is a PMOS device, said discharge transistor is a NMOS transistor, and said transition transistor is a PMOS transistor.

26. A reference voltage integrated circuit as recited in claim 15, wherein said discharge transistor provides active pull-down of the output terminal when said voltage reference integrated circuit is being disabled by the enable signal.

27. A reference voltage integrated circuit as recited in claim 15, wherein said output transistor has a drive capacity greater than a drive capacity of said discharge transistor.

* * * * *